United States Patent [19]

Bartels

[11] Patent Number: 4,716,858

[45] Date of Patent: Jan. 5, 1988

[54] AUTOMATIC FIRING RATE CONTROL MODE MEANS FOR A BOILER

[75] Inventor: James I. Bartels, Hudson, Wis.

[73] Assignee: Honeywell Inc., Minneapolis, Minn.

[21] Appl. No.: 943,094

[22] Filed: Dec. 18, 1986

[51] Int. Cl.[4] ..... F22B 37/42; F22D 5/00

[52] U.S. Cl. ..... 122/448 R; 236/14; 364/494

[58] Field of Search ..... 122/448 R, 448 S; 236/14; 364/494

[56] References Cited

U.S. PATENT DOCUMENTS

| | | | |
|---|---|---|---|
| 3,284,615 | 11/1966 | Yetter | 236/14 X |
| 4,003,342 | 1/1977 | Hodgson | 122/448 R |
| 4,373,663 | 2/1983 | Hammer | 236/15 R |
| 4,403,293 | 9/1983 | Bradt et al. | 364/494 |
| 4,451,003 | 5/1984 | de Mena et al. | 236/14 |
| 4,457,266 | 7/1984 | La Spisa | 122/451.1 |
| 4,498,428 | 2/1985 | La Spisa et al. | 122/448 R |
| 4,574,746 | 3/1986 | Keyes, IV et al. | 122/448 |
| 4,577,270 | 3/1986 | Sugano et al. | 364/151 |
| 4,582,026 | 4/1986 | Takita et al. | 122/448 R |

*Primary Examiner*—Edward G. Favors

*Attorney, Agent, or Firm*—Alfred N. Feldman

[57] ABSTRACT

An automatic firing rate control mode arrangement is provided as a method of operation within a flame safeguard sequencer. The system uses proportional control squared, an integration which reflects the past load history to determine the present load, and further has a constant which relates the rate of change of pressure with respect to time in order to make more responsive the normal load control operation. The system is also capable of on-off control that will hold the system in low fire to allow for stabilization, and to avoid thermal shock to a boiler.

5 Claims, 4 Drawing Figures

AUTOMATIC FIRING RATE CONTROL MODE MEANS FOR A BOILER

BACKGROUND OF THE INVENTION

In the past, boiler pressure has been controlled with a simple proportional control which determines the firing rate (FR) for that particular burner. This can be expressed by the equation of $$FR = \frac{P_{Hi} - P(t)}{P_{Hi} - P_{Lo}}.$$

Where the firing rate is defined as between 0 and +1, $P_{Hi}$ is the upper pressure setpoint for the control of the boiler, and $P_{Lo}$ is the lower pressure setpoint for the boiler. This arrangement will be graphically disclosed in the specification, but generally indicates that at a low pressure in a typical boiler, the firing rate is very high. As the pressure increases, the firing rate is modulated down to what is referred to as a low fire position. The low fire position typically is the lowest safe operating point for the particular fuel burner arrangement.

There are two drawbacks to this type of a control. First is the fact that the greatest firing potential is available under very light load conditions, that is when the firing rate is at a minimum, and a second is the fact that as the $P_{Hi}$ and $P_{Lo}$ approach each other, the system becomes progressively less stable. It is not possible to have a single pressure setpoint with $P_{Hi}$ equal to $P_{Lo}$ with this type of a scheme. This general problem was addressed in the U.S. Pat. No. 4,373,663 which issued Feb. 15, 1985 in the name of Jeffrey M. Hammer, and is assigned to the assignee of the present application.

The Hammer patent addresses this problem in control of the pressure in a boiler by incorporating both a proportional and integral control functions. This can be expressed mathematically as $$FR = K_1E(t) + \sum_{t=0}^{\infty} K_2E(t)\Delta t$$

where $E(t) = P_{Set} - P(t)$
where $P(t)$ = actual pressure at any time (t)
where $P_{Set}$ = pressure setpoint
where $K_1$, $K_2$ are constants
where $\Delta t$ = a unit of time.

The first term of the firing rate formula thus disclosed is comparable to the Hammer arrangement and is similar to a simple proportional control of a boiler. The second term is an integration of the past load history which is used to determine the present load. In order for this control method to be stable, the second term, that is the integral term, must be weighted much heavier than the first or proportional term. This scheme does not allow for a quick response to a step function or fast change in the actual load.

SUMMARY OF THE INVENTION

The present invention recognizes the failings of the control system as proposed in the Hammer U.S. Pat. No. 4,373,663, and addresses this problem by the addition of a further term.

The additional term that is incorporated is the modulation of the firing rate by a third constant that is multiplied by the rate of change of pressure with respect to a unit of time. This third term in such an equation allows a correction to be made before the error becomes large, and therefore provides for a much tighter or more responsive control. This arrangement or method of operation can be implemented by inputting a pressure sensor output from the boiler to a microcomputer or microprocessor that is processing the overall control for both safety and firing rate for the burner and its associated boiler.

A further improvement is squaring the error in the first or proportional term, while preserving the sign of the error. The squaring of the proportional term provides two very desirable attributes. If the error gets large, the squared proportional term is very large and returns the control pressure close to the setpoint very quickly. When the error is small, the proportional term is very small. The control will not react to the small errors and the life of the motor and other equipment related to the system is greatly extended.

The existing methods of providing on-off control and low fire hold can be improved with this arrangement. The on-off control implies that the fuel valve used is completely off or closed, or is on to least some minimum flow setting. In the past, the burners for boilers have been turned off at some pressure above $P_{Hi}$ and on at some pressure below $P_{Lo}$. Assuming there is a minimum pressure that must be maintained, there is a better method for determining the turn on point. During the starting sequence there is a fixed time between the start command from a controller means and the actual firing of the burner to heat the boiler. This time can be determined by a microcomputer that is now available in flame safeguard sequencing equipment. The control is also capable of determining the rate of change of pressure during the off cycle. An "on" cycle can then be initiated when $P_{Start} \geqq P_{Actual}$ where:

$$P_{Start} = P_{Lo} + \frac{\Delta P}{\Delta t} \times T_{Delay} + C$$

In this case, the $P_{Start}$ is based on a minimum allowable boiler pressure, the rate at which the pressure is falling during the off cycle, a fixed time delay, and a constant.

The on-off function can also be implemented in the flame safeguard programmer microcomputer, and provides a further functional benefit in the control. The boiler while being started can be held in a low fire hold position for a fixed period of time immediately following start up in order to stabilize the pressure or water temperature to avoid thermal shock to the boiler. It has been recognized that boilers are subject to rather severe thermal shock when they are started from a cold state, and an attempt is made to bring them up to full pressure immediately.

The present basic control mode can be readily implemented in the flame safeguard sequencer microcomputer through the use of the normal sequencer functions combined with an automatic firing rate control mode means for that device.

In accordance with the present invention, there is provided a flame safeguard sequencer for control of a fuel burner for heating a boiler upon the operation of controller means with said fuel burner having damper means, ignition means, fuel supply means, and flame sensor means, including: a flame safeguard sequencer connected to said damper means, said ignition means, said fuel supply means, and said flame sensor means to sequentially operate said means to properly purge, ignite, and operate said fuel burner in a predetermined sequence upon operation of said controller means to heat said boiler; said flame sensor means energized by said sequencer to monitor said burner for the presence or absence of flame upon said controller means operating to initiate the operation of said fuel burner; means for setting a pressure for said boiler; pressure sensor means for said boiler with said pressure sensor means supplying said sequencer with an electrical signal related to a pressure in said boiler; said flame safeguard sequencer further including automatic firing rate control mode means responsive to said pressure related signal in said boiler; said automatic firing rate control mode means providing at least three functions to cause said boiler to be heated in a safe and efficient manner; a first of said functions including a proportional control function which is proportional to a difference in a set pressure for said boiler to an actual pressure in said boiler; said proportional control function being squared while preserving the mathematical sign of the said function; a second of said functions including an integration of a load history of said boiler operating for a previous period of time; and a third of said functions including a further constant times the rate of change of pressure within said boiler with respect to time to allow said automatic firing rate control mode means to correct any errors in heating of said boiler before said error becomes large thereby providing a highly responsive control of said operation of said boiler.

DESCRIPTION OF THE PREFERRED EMBODIMENT

Figure 1:
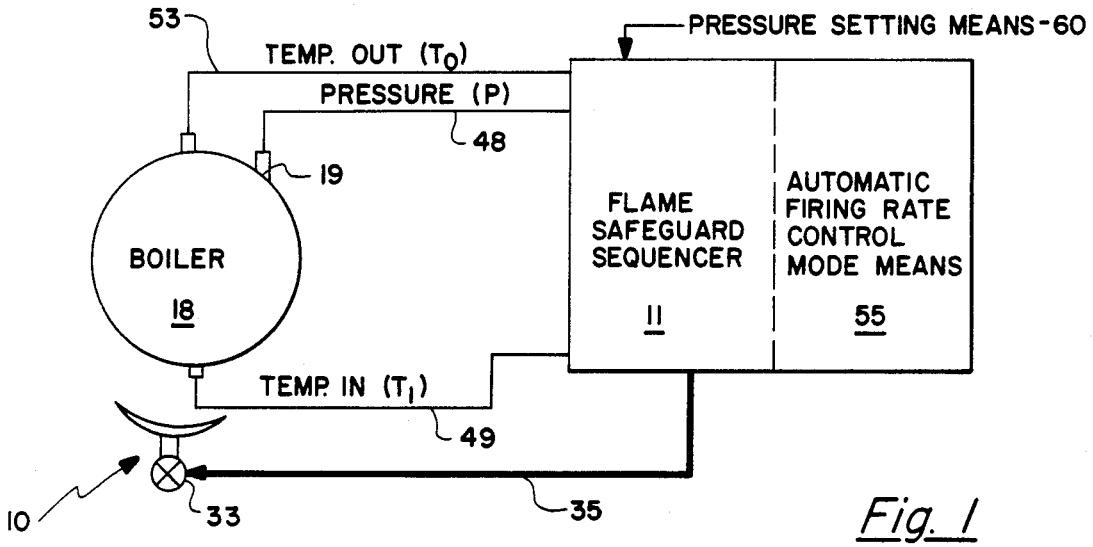
FIG. 1 is a block diagram of a simple boiler and control arrangement.

FIG. 1 is a block or schematic representation of a burner means 10 for supplying heat to a boiler 18. The burner 10 is controlled by a flame safeguard sequencer generally disclosed at 11 through the expedience of a conductor 35 to a valve 33 for the burner means 10. In a modulating system, valve 33 is either controlled by a motor or is a motorized type valve. While the block form disclosed in FIG. 1 is of the complete concept including the invention, a simplified form will first be briefly discussed in order to emphasize the problem solved by the present invention and its area of novelty.

Boiler 18 has a pressure sensor 19 and a conductor 48 to convey pressure information to the flame safeguard sequencer 11. A pressure setting means 60 is provided to establish the operating point for the pressure within the boiler 18. Also associated with the boiler 18 are means for measuring the temperature output at 53 from the boiler 18, while measuring the temperature of the fluid input at 49. The invention is completed by providing within the flame safeguard sequencer 11 a means within its microcomputer that has been identifed as the automatic firing rate control mode means 55. The automatic firing rate control means 55 will be discussed in some detail in connection with the flow chart of FIG. 4. A simple sequence of a system not including the automatic firing rate control mode means 55 will be discussed in order to point out the advantage of this novel system.

Figure 2:
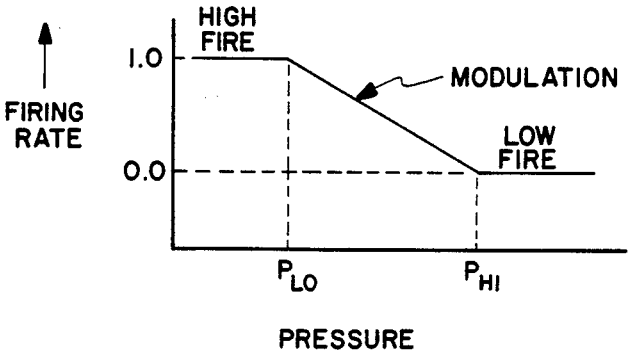
FIG. 2 is a graphic representation of a typical control mode.

In FIG. 2 a simple pressure versus firing rate diagram is provided. A firing rate between 0 and 1.0 is disclosed as being between the low fire and high fire settings for the burner means 10. It is understood in the burner art that some low fire setting is required to maintain a stable burner operation is provided, while a maximum rate of burner operation is indicated or referred to as the high fire operation. During the operation of a burner means 10 under the control of a flame safeguard sequencer 11, typically the burner means 10 is operated in a modulated fashion between the high fire and the low fire conditions.

After an initial start up of the burner means 10, the conventional flame safeguard sequencer 11 would operate the system to its high fire mode which is when the pressure within the boiler is low as indicated at $P_{Lo}$ in FIG. 2. The burner is then modulated down as the pressure increases until the highest desirable pressure $P_{Hi}$ is attained at low fire operation. The problems of this type of operation were discussed in some detail in the background of the invention and have been representated graphically merely to emphasize operating characteristics.

Figure 3:
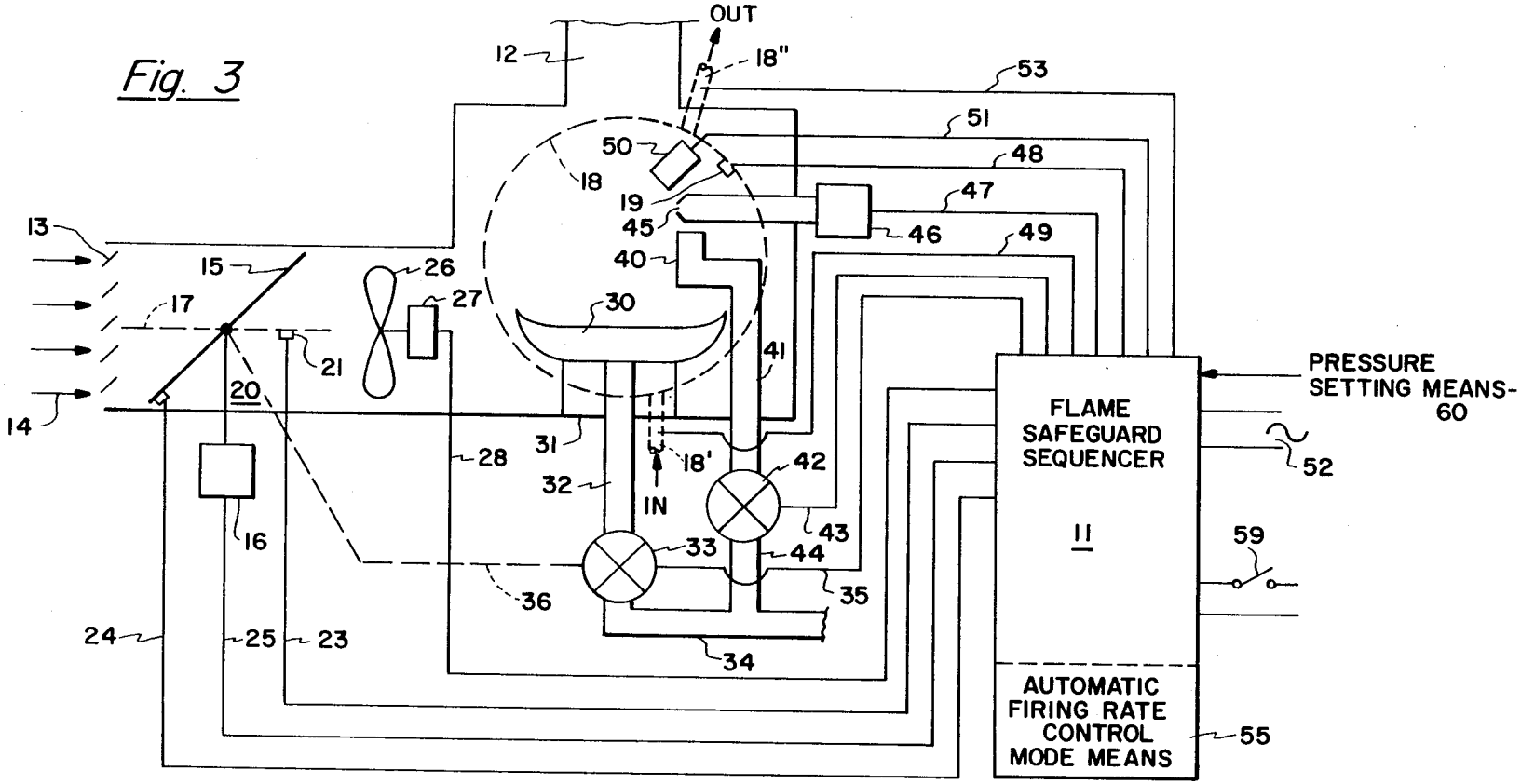
FIG. 3 is a schematic reprsentation of a fuel burner including the novel sequencer.

In FIG. 3 there is schematically disclosed the fuel burner means 10 which is operated under the control of the flame safeguard sequencer 11. The fuel burner means 10 could be any type of burner such as a gas fired burner, an oil fired burner, or a burner which utilizes both fuels. The flame sequencer 11 typically would operate the fuel burner means 10 in any conventional sequence such as example, a prepurge, trial for pilot or trial for ignition, trial for main flame, main flame run or modulation, and a post-purge sequence. The fuel burner means 10 is disclosed as having a stack 12 and an air inlet 13 with air flow schematically indicated at 14. The air inlet 13 is regulated by a damper 15 that is driven by a damper drive motor means 16. The damper 15 is shown in a semi-closed position which will be referred to as the low fire position. A second position disclosed at 17, with the damper open, is referred to as the high fire position.

A high fire and low fire switch means is disclosed at 20 and includes a pair of switches 21 and 22. The switch 21 is activated by the damper 15 when it reaches the position shown at 17. The switch 22 is activated by the damper 15 in the position shown. Both the switches 21 and 22 are normally open electrical switches which close to change the electrical state of the flame safeguard sequencer 11 to indicate the proper operation of the damper 15 between the position shown and the position 17. The switch 21 is connected by conductors 23 to the flame safeguard sequencer 11, while the switch 22 is connected by conductors 24 to the flame safeguard sequencer 11. The drive motor means 16 is connected by conductors 25 to the flame safeguard sequencer 11 so that the motor means 16 can be operated to drive the damper 15 to in turn properly actuate the switches 21 and 22.

The fuel burner means 10 further has a fan or air source 26 driven by a conventional motor 27 that is connected by conductors 28 to the sequencer 11. The fan 26 provides the burner means 10 with the air flow 14 from the inlet 13 to the stack 12 to provide combustion air and to provide a pre-purge and post-purge operation of the burner, when required.

A burner is schematically disclosed at 30 mounted to a bottom 31 of the fuel burner means 10 and supplied with a pipe 32 from the valve 33 connected to a fuel line 34. The valve 33 is connected by electric conductors 35 to the sequencer 11, and also can be connected by a linkage 36 to the damper 15. Valve 33 is usually made up of two valves one for on/off control, and one for modulation. This is done in order to adjust the flow of fuel through the valve 33 with the position of the damper 15, in addition to controlling the fuel flow through the valve 33, and the on-off function by electric conductors 35.

A pilot burner 40 is disclosed at the main fuel burner 30 and is connected by a pipe 41 to a pilot fuel valve 42 that has an electrical connection means or conductors 43 connected to the sequencer 11. The pilot fuel valve 42 is connected by a pipe 44 to the main fuel pipe 34, as would be used in a gas installation. The particular type of fuel for the main burner 30 and the pilot burner 40 is not material to the present invention, and the presently disclosed arrangement is schematic in nature in order to provide an explanation of operation of the present invention.

The fuel burner means 10 is completed by the provision of an ignition source 45 disclosed as a pair of spark electrodes which are connected to a spark generating means 46 that is connected by conductors 47 to the sequencer 11 to receive power and control. Also, provided is a flame sensor means 50 that is connected by conductors 51 to the flame safeguard sequencer 11. The pressure sensor 19 is again disclosed, and is connected by conductors 48 to the sequencer 11. The boiler 18 has an inlet 18' and an outlet 18'' for the boiler 18 which has been shown in phantom for reference. The inlet temperature is provided by conductors 49 to the sequencer 11, while the outlet temperature is provided by conductors 53 to the sequencer means 11. The sequencer means 11 is energized by a conventional line source at 52, and the fuel burner means 10 is initiated by a controller 59. The controller 59 could be a temperature responsive controller, or a controller of any other type. The necessary pressure setting is shown as an input to the sequencer 11 at the pressure setting means 60. The flame safeguard sequencer 11 has a normal sequencing portion, and has a further portion 55 that is the automatic firing rate control mode means, as will be described briefly in a mathematical presentation and then further described by the use of a flow chart disclosing the novel portion of the present invention.

As was disclosed in the Background of the Invention, the firing rate in traditional or previously known systems was made up of a first term that was similar to or in principle a proportional control, while including a second term that is an integration of the past load history and is used to determine the present load. In order to utilize this type of a control method and yet be stable, the second term, that is the integral term, typically would be weighted much heavier than the first or proportional term. This type of a scheme does not allow for a quick response to a step or fast change in the actual load.

In order to overcome this problem, the present invention utilizes an automatic firing rate control mode means 55 that has a further term in the form of a constant times the rate of change of pressure with respect to time as well as the squaring of the first or proportional term. The third term allows a correction to be made before the error becomes large, and therefore provides for a tighter or more responsive control.

In the present flame safeguard sequencer 11 a microprocessor or microcomputer is used to implement the control functions. A microprocessor operated flame safeguard control has been on the market and is identified as the Honeywell BC7000. With the present invention, the automatic firing rate control mode means 55 is provided to implement a tighter or better control by inputting a pressure signal on conductors 48 from the sensor 19, and outputting a firing rate to the boiler 18 that is more responsive than that available previously. Matching the firing rate to the load is commonly known as modulating control. With the present invention that control is tighter or more responsive. Also, in connection with the start up of the present unit, there is an off-on control function and a low fire hold control. Both of these functions are generally found in the previously known systems, but they are typically used only as a means of initiating operation of the boiler and allowing a stabilizing period for the burner itself. The on-off control and low fire hold are used in the present invention in additional modes. These will become apparent when the flow chart of FIG. 4 is considered.

In past boiler control systems the burners have been turned off at some pressure above $P_{Hi}$, and on at some pressure below $P_{Lo}$. Assuming there is a minimum pressure which must be maintained, there is a more desirable and novel method of determining the turn on point. This is accomplished in the present automatic firing rate control mode means 55. During the starting sequence there is a fixed time between the start command and the actual firing of the boiler. This time can be determined by the microcomputer within the flame safeguard sequencer 11. This control is also capable of determining the rate of change of pressure during the off cycle. An on cycle can then be initiated when the start pressure falls below the actual pressure and incorporates a time delay between the start command and the actual firing of the boiler.

The on-off function that is implemented in the present control or microcomputer within the flame safeguard sequencer by the automatic firing rate control mode means 55 can also provide a low fire hold operation at the outset of the operation of the device. This can be used as a fixed time period immediately following the start up for stabilization to allow the water temperature in the boiler to reach some minimum temperature, and the differential temperatures between the output and the input to reach a minimum temperature. All of these functions are provided to avoid thermal shock to a boiler just being put into operation. The thermal shock control typically has been an incidental in boiler control, and has not been readily accommodated because of the severe limitations of the older style electromechanical flame safeguard sequencers. The present automatic firing rate control mode means 55 allows the implementation of the desired control functions, and also provides for direct manual control of the firing rate through a keyboard entry (not disclosed) when in a manual mode of control. A manual mode of control has been available on previously mentioned earlier equipment.

Figure 4:
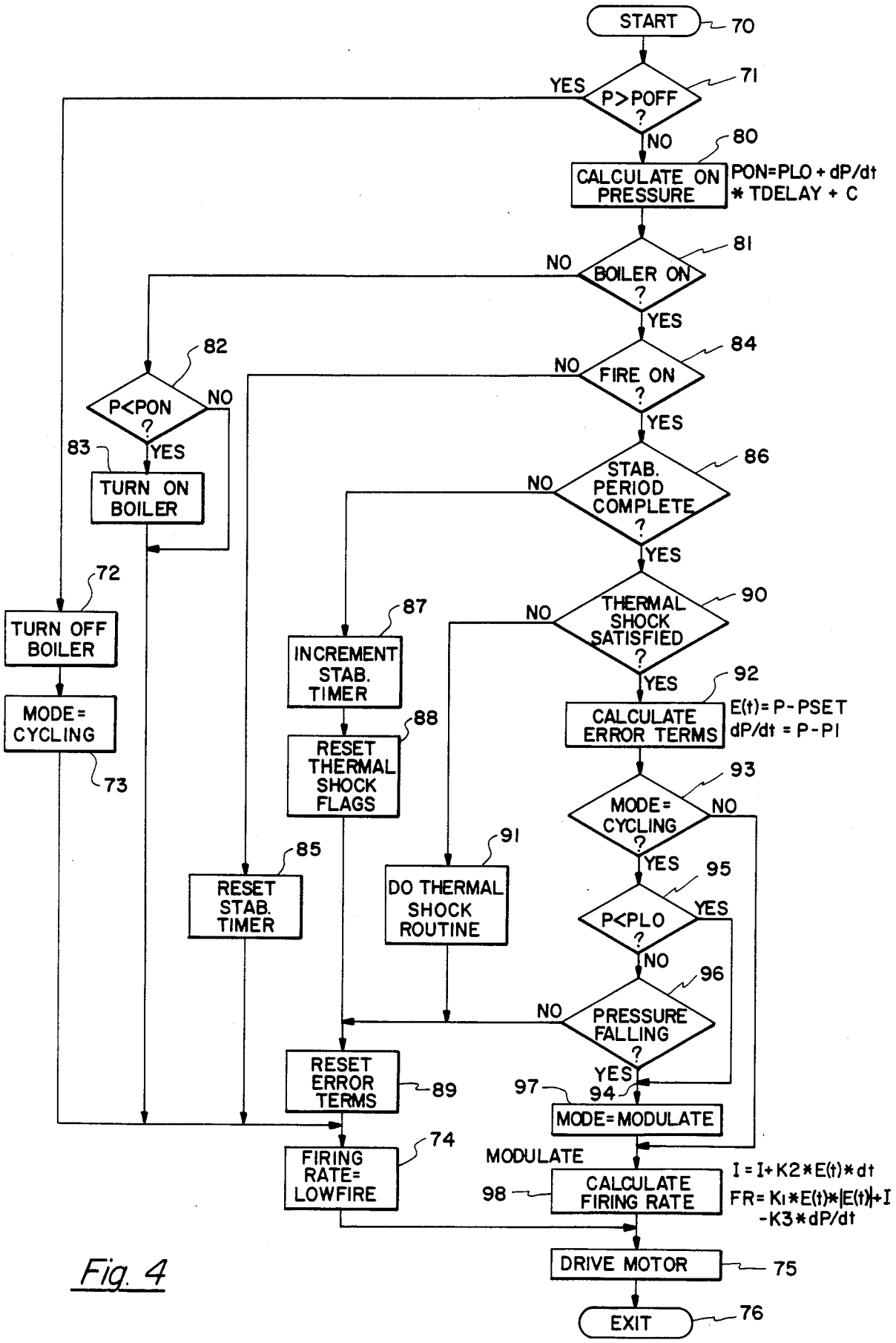
FIG. 4 is a flow chart of the novel portion of operation of the system of FIG. 3.

Before the detailed sequence of operation of the device is provided by the flow chart of FIG. 4, a table of abbreviations is provided. In order to facilitate the presentation of the flow chart of FIG. 4, a number of abbreviations have been used. The following Table 1 discloses the definitions of those abbreviations in detail.

TABLE 1

P=OPERATING STEAM PRESSURE
dP/dt=CHANGE IN PRESSURE OVER TIME (5 SEC. TYP.)
P1=PRESSURE FROM READING 5 SECONDS AGO (t−5)
E(t)=PRESSURE ERROR (DEVIATION FROM SETPOINT)
PSET=SETPOINT PRESSURE (DESIRED OPERATING POINT)
PON=PRESSURE AT WHICH THE BURNER TURNS ON
POFF=PRESSURE AT WHICH THE BURNER TURNS OFF
PLO=MINIMUM ACCEPTABLE OPERATING PRESSURE
K1=PROPORTIONAL GAIN CONSTANT
K2=INTEGRAL GAIN CONSTANT
K3=DIFFERENTIAL GAIN CONSTANT
I=INTEGRAL GAIN (SUM OF PAST ERRORS)
C=CONSTANT (SAFETY MARGIN)
TDELAY=TIME DELAY (PREPURGE +TRIAL FOR IGNITION)
FR=BURNER FIRING RATE
STAB.=STABILIZATION PERIOD (20 SEC. TYPICAL)
CYCLING MODE=BOILER LOAD IS LESS THAN THE MINIMUM FIRING RATE OF THE BOILER

In FIG. 4 a complete flow chart of the automatic firing rate control mode means 55 is disclosed. This disclosure will rely on Table 1 and also will include specific computations at appropriate points with the computations being adjacent the block in which that function occurs.

At the start of the sequence 70 the control makes a determination at 71 whether pressure is greater than the pressure at which the burner turns off. If that is found to be true, the system operates at 72 to turn off the boiler, and then operates at 73 to set the mode equal to the cycling mode. The system then sets the firing rate to be equal to the low fire setting as disclosed at 74. The necessary setting of the drive motor 16 is accomplished at 75 prior to an exit at 76.

If at 71 the pressure is less than the pressure at which the burner turns off, the system calculates at 80 the on pressure for the system. The pressure at which the burner turns on is shown as being equal to the minimum acceptable operating pressure plus the rate of change of pressure with respect to time times the time delay used for prepurge and trial for ignition along with a constant. After the on pressure calculation, a determination is made at 81 of whether the burner is in fact on. If not, at 82 a determination is made as to whether the pressure is less than the pressure at which the burner turns on. If it is, the system moves on to 83 where the burner is turned on. If not, the burner turn on at 83 is bypassed and the system operates again to the low firing rate 74 and operates the drive motor 75.

If at 81 the boiler is on, the system then checks at 84 to determine if the fire is present in the burner. If not, a reset stabilization operation at 85 occurs and the system exits through 74, 75 and the exit 76.

If fire is on at 84, a determination is made at 86 of whether the stabilization period is complete. If not, an incremented stabilization timer 87 is operated, and at 88 reset thermal shock flags are set within the microcomputer. The system then resets the error terms at 89 before moving on to the firing rate equal to the low fire position 74.

If the stabilization period is complete at 86 a determination is made at 90 whether a thermal shock timing has been satisfied. If not, at 91 the system does a routine to prevent thermal shock to the boiler prior to a reset of the error items at 89, and the setting of the firing rate at low fire at 74.

If the thermal shock is satisfied at 90, the system at 92 calculates the error terms that then exist. The net result of that calculation is a determination of the operating steam pressure less any pressure reading from a short interval of time (approximately five seconds) previously have been satisfied.

As soon as the calculation at 92 is complete, the system operates at 93 to determine whether the system is in the cycling mode. If not, the mode is equal to a modulating mode.

Assuming that the mode equals the cycling mode, the system moves to determine at 95 whether the pressure is less then the minimum acceptable operating pressure. If not, the system determines at 96 whether the pressure is falling. If it is not falling, the system reenters the reset error mode 89 and the firing rate equal to the low fire setting 74. In the event that the pressure is falling, the mode is set equal to the modulating mode 97 where the junction with 94 occurs. The system then calculates at 98 the firing rate for the system. The firing rate formulas have been previously noted, and basically include a squared proportional term, an integration of the past load history, and then a constant times the rate of pressure with respect to time in order to insure that the automatic firing rate is held as tight or responsive as possible without creating an unstable condition.

After the calculation of the firing rate at 98 is complete, the drive motor is set at 75 and the system exits at 76.

A complete flow chart of the operation of the flame safeguard sequencer 11 with the automatic firing rate control mode means 55 is contained in FIG. 4 along with its associated Table 1. The present system accomplishes a determination of the firing rate by either of the previously mentioned formulas:

$$FR = K_1E(t) * |E(t)| + \sum_{t=0}^{\infty} K_2E(t)\Delta t - K_3\frac{\Delta P}{\Delta t} \text{ or}$$

$$FR = K_1E(t) * |E(t)| * abs(E(t)) + I - K_3 * dP/dt$$

As has been previously stated, the automatic firing rate control mode means 55 also allows for sensing the pressure changes during an off cycle, an off-on implementation, and a low fire hold implementation in order to stabilize the boiler and to avoid thermal shock. Since the present invention is susceptible to a number of different implementations, the applicant wishes to be limited in the scope of his invention solely by the scope of the appended claims.

The embodiments of the invention in which an exclusive property or right is claimed are defined as follows:

1. A flame safeguard sequencer for control of a fuel burner for heating a boiler upon the operation of controller means with said fuel burner having damper means, ignition means, fuel supply means, and flame sensor means, including: a flame safeguard sequencer connected to said damper means, said ignition means, said fuel supply means, and said flame sensor means to sequentially operate said means to properly purge, ignite, and operate said fuel burner in a predetermined sequence upon operation of said controller means to heat said boiler; said flame sensor means energized by said sequencer to monitor said burner for the presence or absence of flame upon said controller means operating to initiate the operation of said fuel burner; means for setting a pressure for said boiler; pressure sensor means for said boiler with said pressure sensor means supplying said sequencer with an electrical signal related to a pressure in said boiler; said flame safeguard sequencer further including automatic firing rate control mode means responsive to said pressure related signal in said boiler; said automatic firing rate control mode means providing at least three functions to cause said boiler to be heated in a safe and efficient manner; a first of said functions including a proportional control function which is proportional to a difference in a set pressure for said boiler to an actual pressure in said boiler; said proportional control function being squared while preserving the mathematical sign of said function; a second of said functions including an integration of a load history of said boiler operating for a previous period of time; and a third of said functions including a further constant times the rate of change of pressure within said boiler with respect to time to allow said automatic firing rate control mode means to correct any errors in heating of said boiler before said error becomes large thereby providing a highly responsive control of said operation of said boiler.

2. A flame safeguard sequencer as claimed in claim 1 wherein said second of said functions being a summation from time equal to zero until infinity, times a constant multiplied by said difference in a set pressure for said boiler to an actual pressure in said boiler for a unit of time.

3. A flame safeguard sequencer as claimed in claim 1 wherein said first of said functions includes a constant times the difference squared in a set pressure and an actual pressure in said boiler.

4. A flame safeguard sequencer as claimed in claim 2 wherein said automatic firing rate control mode means further includes an on-off function for said boiler; said on-off function including a time delay between said controller means initiating operation of said fuel burner; and said fuel burner including a low fire hold position to allow for stabilization of said boiler and to provide a minimum boiler temperature to avoid thermal shock to said boiler that might occur if normally high fired fuel burner operation was permitted.

5. A flame safeguard sequencer as claimed in claim 3 wherein said automatic firing rate control mode means further includes an on-off function for said boiler; said on-off function including a time delay between said controller means initiating operation of said fuel burner; and said fuel burner including a low fire hold position to allow for stabilization of said boiler and to provide a minimum boiler temperature to avoid thermal shock to said boiler that might occur if normally high fired fuel burner operation was permitted.

* * * * *